US009146506B2

(12) United States Patent
Yoshizawa et al.

(10) Patent No.: US 9,146,506 B2
(45) Date of Patent: Sep. 29, 2015

(54) SURFACE PROTECTIVE FILM, TRANSFER MEMBER, IMAGE FORMING APPARATUS, AND METHOD FOR FORMING IMAGE

(71) Applicant: FUJI XEROX CO., LTD., Tokyo (JP)

(72) Inventors: Hisae Yoshizawa, Kanagawa (JP); Kazunori Anazawa, Kanagawa (JP); Hiroshi Saegusa, Kanagawa (JP); Kaoru Torikoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 222 days.

(21) Appl. No.: 13/746,934

(22) Filed: Jan. 22, 2013

(65) Prior Publication Data

US 2013/0240793 A1 Sep. 19, 2013

(30) Foreign Application Priority Data

Mar. 14, 2012 (JP) ..... 2012-056996
Aug. 13, 2012 (JP) ..... 2012-179472

(51) Int. Cl.

| | |
|---|---|
| ***H01B 1/00*** | (2006.01) |
| ***H01B 1/06*** | (2006.01) |
| ***G03G 15/01*** | (2006.01) |
| ***G03G 15/16*** | (2006.01) |

(52) U.S. Cl.
CPC ..... *G03G 15/162* (2013.01)

(58) Field of Classification Search
None
See application file for complete search history.

(56) References Cited

U.S. PATENT DOCUMENTS

| | | | | |
|---|---|---|---|---|
| 2011/0200837 | A1* | 8/2011 | Yoshizawa et al. | 428/500 |
| 2012/0022215 | A1* | 1/2012 | Yoshizawa et al. | 525/100 |
| 2012/0080068 | A1* | 4/2012 | Bae et al. | 136/244 |
| 2012/0195656 | A1* | 8/2012 | Saegusa et al. | 399/333 |
| 2013/0051880 | A1* | 2/2013 | Yoshizawa et al. | 399/333 |
| 2013/0234080 | A1* | 9/2013 | Torikoshi et al. | 252/519.31 |

FOREIGN PATENT DOCUMENTS

| | | |
|---|---|---|
| JP | A-10-034763 | 2/1998 |
| JP | A-10-039645 | 2/1998 |
| JP | A-2001-173639 | 6/2001 |
| JP | A-2002-182487 | 6/2002 |
| JP | A-2003-003067 | 1/2003 |

OTHER PUBLICATIONS

Buschow, K.H. Jürgen Cahn, Robert W. Flemings, Merton C. Ilschner, Bernhard Kramer, Edward J. Mahajan, Subhash (2001). Encyclopedia of Materials—Science and Technology, vols. 1-11—Carbon Blacks. Elsevier. Online version available at: http://app.knovel.com/hotlink/pdf/id:kt00B79OK2/encyclopedia-materials/carbon-blacks.*

Morgan, Peter. (2005). Carbon Fibers and Their Composites—2.10.1 Carbon Black. Taylor & Francis. Online version available at: http://app.knovel.com/hotlink/pdf/id:kt00U0F897/carbon-fibers-their-composites/carbon-black.*

* cited by examiner

*Primary Examiner* — Harold Pyon
*Assistant Examiner* — Jaison Thomas
(74) *Attorney, Agent, or Firm* — Oliff PLC

(57) ABSTRACT

A surface protective film includes a self-healing urethane resin and a conductive powder. In the surface protective film, the content of the conductive powder is about 5 vol % or more and about 25 vol % or less relative to the volume of the urethane resin.

11 Claims, 1 Drawing Sheet

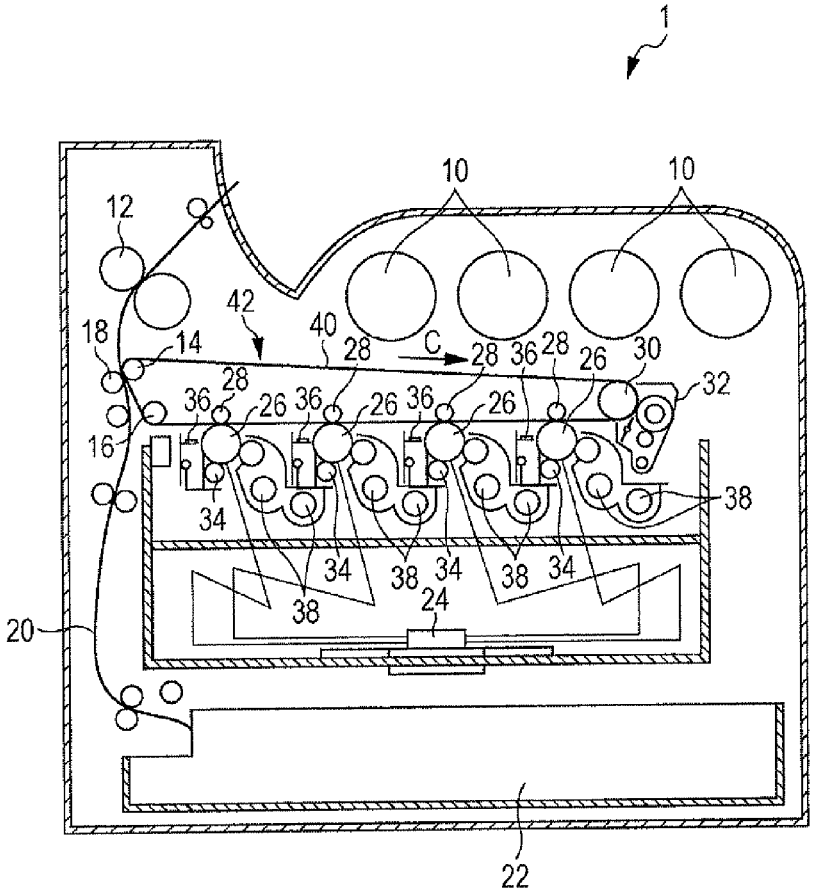
1
10
10
12
42
40
18
14
28
C
28
36
28
26
30
32
28
36
26
36
26
36
26
16
34
38
34
38
34
38
34
38
24
20
22

SURFACE PROTECTIVE FILM, TRANSFER MEMBER, IMAGE FORMING APPARATUS, AND METHOD FOR FORMING IMAGE

CROSS-REFERENCE TO RELATED APPLICATIONS

This application is based on and claims priority under 35 USC 119 from Japanese Patent Application Nos. 2012-056996 filed Mar. 14, 2012 and 2012-179472 filed Aug. 13, 2012.

BACKGROUND (i) Technical Field

The present invention relates to a surface protective film, a transfer member, an image forming apparatus, and a method for forming an image.

(ii) Related Art

A surface protective film has been conventionally disposed to suppress formation of scratches on a surface in various fields. Such a surface protective film is used for, for example, a screen and body of portable devices such as cellular phones and portable gaming devices, a body and door knob of automobiles, the exterior of a piano, a protective film for protecting an intermediate transfer body or the like in image forming apparatuses.

An image forming apparatus including an intermediate transfer body will now be described. A process for visualizing image information using an electrostatic latent image, such as an electrophotographic process, is now being utilized in various fields. In the electrophotographic process, image information is visualized through a charging and exposing step (latent image forming step) of forming a latent image (electrostatic latent image) on an image carrier, a developing step of developing the electrostatic latent image with a developer for developing electrostatic latent images (hereinafter may be simply referred to as "developer"), the developer containing a toner for developing electrostatic latent images (hereinafter may be simply referred to as "toner"), a transferring step, and a fixing step.

Various transferring processes for transferring a toner image, such as corotron discharge and contact transfer, have been employed. In the contact transfer, a method that uses a conductive roller or belt composed of a polyurethane including conductive particles such as carbon particles dispersed therein has been developed.

SUMMARY

According to an aspect of the invention, there is provided a surface protective film including a self-healing urethane resin and a conductive powder, wherein a content of the conductive powder is about 5 vol % or more and about 25 vol % or less relative to the volume of the urethane resin.

BRIEF DESCRIPTION OF THE DRAWINGS

Exemplary embodiment of the present invention will be described in detail based on the following FIGURE, wherein:

FIGURE is a schematic diagram illustrating an example of an image forming apparatus according to an exemplary embodiment of the invention.

DETAILED DESCRIPTION

An exemplary embodiment of the present invention will be described below. This exemplary embodiment is an example of conducting the present invention, and the present invention is not limited to this exemplary embodiment.

<Surface Protective Film>

A surface protective film according to this exemplary embodiment includes a self-healing urethane resin and a conductive powder whose content is 5 vol % or more and 25 vol % or less or about 5 vol % or more and about 25 vol % or less relative to the volume of the urethane resin.

The surface protective film according to this exemplary embodiment is used, without being limited, for products in which scratches are formed on the surface while at the same time electrostatic charge is generated due to contact with foreign matter.

Examples of the products in which scratches are formed on the surface while at the same time electrostatic charge is generated due to contact with foreign matter include a screen and body of portable devices such as cellular phones and portable gaming devices, a body and door knob of automobiles, the exterior of a piano, a transfer member in image forming apparatuses, and a hanger.

The screen and body of portable devices such as cellular phones and portable gaming devices may become scratched as a result of contact with and rubbing against the tips (nails) of fingers or the tip of a control stick. Furthermore, static electricity builds up on the screen and body as a result of rubbing against, for example, a cloth in a bag or a clothes pocket, and thus dust easily adheres to the screen and body.

The body and door knob of automobiles are exposed to an outdoor environment and thus may become scratched due to various factors such as contact with sand, leaves, branches, and the like that are carried by wind and contact with insects. Furthermore, static electricity builds up due to exposure to an outdoor environment, and thus dust easily adheres to the body and door knob. In particular, when a person touches a door knob being charged with static electricity, the static electricity is discharged.

The exterior of a piano may become scratched as a result of contact with musical instruments being played by other players or contact with various objects caused when the piano itself is moved. Furthermore, the exterior of a piano is often wiped with a dry cloth when cleaning. Static electricity builds up as a result of rubbing with the dry cloth, and thus dust easily adheres to the exterior.

The transfer member in image forming apparatuses may become scratched as a result of contact with and rubbing against recording media such as paper and other members in image forming apparatuses. Furthermore, static electricity builds up due to repeated contact and detachment of the transfer member with recording media such as paper, and thus dust easily adheres to the transfer member.

In addition to the above examples, if an object having a surface in contact with foreign matter rubs against other objects, scratches are formed on the surface of a surface protective film and static electricity builds up on the surface due to rubbing against the foreign matter.

The surface protective film according to this exemplary embodiment includes a self-healing urethane resin. It is believed that such a self-healing urethane resin does not directly react to the impact, but flexibly yields once to reduce the impact and then bends back with its high elastic force, resulting in recovery to the original state. In other words, it is believed that high scratch resistance (difficulty in formation of scratches) and high scratch healing speed (restoration of formed scratches) are achieved. By applying a surface protective film including the self-healing urethane resin to the surface of an object on which scratches are likely to be formed as a result of contact with foreign matter, even when the object is rubbed against foreign matter, the formation of scratches is suppressed because of the high scratch resistance and the high scratch healing speed.

Since the surface protective film according to this exemplary embodiment includes a conductive powder, high conductivity is imparted. Therefore, it is believed that electrostatic charge is efficiently suppressed and thus the adhesion of dust is efficiently suppressed.

When an additive such as a conductive powder is added to the self-healing urethane resin, the self-healing property tends to decrease in general. However, the surface protective film according to this exemplary embodiment contains a conductive powder at the above-described ratio. Therefore, electrostatic charge is suppressed and an excellent self-healing property is produced, and consequently it is believed that the adhesion of dust is suppressed and the formation of scratches (permanent scratches) permanently left on the surface is sufficiently suppressed.

In particular, in the transfer member in an image forming apparatus, voltage is applied when an image forming material (e.g., toner) is transferred from the surface of an electrostatic latent image carrier such as a photoconductor, which sometimes generates discharge between the electrostatic latent image carrier and the transfer member. Voltage is also applied when an image forming material on the transfer member is transferred onto a recording medium such as paper, which also sometimes generates discharge between the transfer member and a member facing the transfer member with the recording medium therebetween. The transfer member degrades due to the repetition of such discharge, which shortens the life of the transfer member.

The surface protective film according to this exemplary embodiment includes the self-healing urethane resin and the conductive powder at the above-described ratio relative to the urethane resin. Therefore, in the surface protective film according to this exemplary embodiment, high conductivity is imparted and an excellent self-healing property is produced, and thus it is believed that the formation of scratches as a result of contact with and rubbing against a recording medium is suppressed and the discharge degradation is sufficiently suppressed.

Since a self-healing material has high elasticity, such a self-healing material is useful in the application to embossed paper or the like.

For the purpose of producing an excellent self-healing property, suppressing electrostatic charge, and more efficiently suppressing discharge degradation, the content of the conductive powder is preferably 8 mass % or more and 30 mass % or less or about 8 mass % or more and about 30 mass % or less relative to the mass of the urethane resin.

The urethane resin in this exemplary embodiment includes at least one of a structural unit containing silicone and a structural unit containing a fluorine atom. Therefore, high releasability is imparted to the surface protective film that has resistance to scratches and is excellent in suppression of electrostatic charge.

—Definition of Self-Healing Property—

The "self-healing property" is a property of restoring the original state of an object undergoing distortion when stress causing the distortion is unloaded. Specifically, the self-healing property in this specification means that the "restoration ratio" determined by the following measurement method is 80% or more or about 80% or more.

The restoration ratio of the surface protective film according to this exemplary embodiment is preferably 90% or more and 100% or less or about 90% or more and about 100% or less.

Method for Measuring Restoration Ratio

FISCHERSCOPE HM2000 (manufactured by Fischer Instruments K.K.) is used as a measurement device for the restoration ratio. A coating solution for forming surface protective films is applied onto a polyimide film and polymerized to form a sample surface protective film. The sample surface protective film is fixed on a slide glass with an adhesive and the slide glass is set in the measurement device. A load is applied to the sample surface protective film up to 0.5 mN at a particular measurement temperature over 15 seconds and held at 0.5 mN for 5 seconds. The maximum displacement at this timing is defined as (h1). Subsequently, the load is decreased to 0.005 mN over 15 seconds and held at 0.005 mN for 1 minute. The displacement at this timing is defined as (h2). The restoration ratio is calculated from the formula $[\{(h1-h2)/h1\}\times 100(\%)]$.

The restoration ratio mentioned in this specification is measured by this method.

—Self-Healing Temperature—

The temperature at which the self-healing property is produced in the surface protective film according to this exemplary embodiment (self-healing temperature at which the restoration ratio is 80% or more or about 80% or more) may be any temperature as long as the temperature is in a temperature range in which a resin constituting the surface protective film maintains the form of the surface protective film. Therefore, the "particular measurement temperature" in the method for measuring the restoration ratio is any temperature in the above-described temperature range.

For the purpose of more efficiently healing scratches, the self-healing temperature of the surface protective film according to this exemplary embodiment is preferably 10° C. or more and 100° C. or less, more preferably 10° C. or more and 80° C. or less, and particularly preferably 10° C. or more and 50° C. or less.

—Temperature for Scratch Healing—

Even in the case where the surface protective film according to this exemplary embodiment is left at a temperature other than the self-healing temperature, scratches are suitably healed by taking a longer time (e.g., more than one minute when a load is applied under the same conditions as the method for measuring the restoration ratio to form scratches).

For the purpose of more efficiently healing scratches, the surface protective film according to this exemplary embodiment is preferably used at the temperature at which a self-healing property is produced (self-healing temperature at which the restoration ratio is 80% or more or about 80% or more).

Heat may be applied to the surface protective film according to this exemplary embodiment by a method for externally applying heat such as a method in which hot air is provided using a hot air blower such as a dryer, a method in which frictional heat is provided by rubbing the surface of the surface protective film with a cloth, a method in which the surface protective film is detached once, immersed in hot water, and pasted again, and a method in which the surface protective film is detached once, inserted into a heating furnace, and pasted again. In the method for applying heat, the surface protective film may be heated to the self-healing temperature.

[Composition of Surface Protective Film]

The composition of the surface protective film will now be described.

Conductive Powder

The conductive powder in this exemplary embodiment is added to the urethane resin at the above-described volume ratio so that the surface resistivity of the surface protective film is controlled within the range of $1\times10^8$ Ω/sq. or more and $1\times10^{14}$ Ω/sq. or less.

The conductive powder included in the surface protective film is not particularly limited as long as the above requirement is satisfied. Examples of the conductive powder include carbon blacks such as Ketjenblack and acetylene black; graphite; metals and alloys such as aluminum, nickel, and copper alloys; metal oxides such as titanium oxide, tin oxide, zinc oxide, potassium titanate, a complex oxide of tin oxide and indium oxide, and a complex oxide of tin oxide and antimony oxide; and conductive polymers such as polyaniline, polypyrrole, polysulfone, and polyacetylene. Among them, carbon black and titanium oxide are preferably used and carbon black is more preferably used in terms of control of resistance. These conductive powders may be used alone or in combination of two or more.

The content of the conductive powder in the surface protective film is 5 vol % or more and 25 vol % or less or about 5 vol % or more and about 25 vol % or less and preferably 7 vol % or more and 15 vol % or less or about 7 vol % or more and about 15 vol % or less relative to the volume of the self-healing urethane resin. If the content of the conductive powder is less than the lower limit, desired conductivity is not achieved. If the content is more than the upper limit, the self-healing function of the surface protective film is degraded because the cross-linking of the self-healing material is inhibited.

In terms of mass ratio, the content of the conductive powder in the surface protective film is preferably 8 mass % or more and 30 mass % or less or about 8 mass % or more and about 30 mass % or less and more preferably 10 mass % or more and 20 mass % or less or about 10 mass % or more and 20 mass % or less relative to the mass of the self-healing urethane resin for the purpose of achieving both desired conductivity and self-healing function.

The average particle size of the conductive powder in the surface protective film is preferably 10 nm or more and 30 nm or less or about 10 nm or more and about 30 nm or less and more preferably 15 nm or more and 25 nm or less or about 15 nm or more and about 25 nm or less. When the average particle size of the conductive powder is 10 nm or more, the conductive powder is appropriately dispersed. When the average particle size is 30 nm or less, proper electrical connection is established without impairing the self-healing function.

The average particle size of the conductive powder is measured using a transmission electron microscope (H-9000 manufactured by Hitachi High-Technologies Corporation). The average particle size is an average of particle sizes of 100 particles measured. The particle size mentioned in this specification is measured by the above method.

The surface resistivity of the surface protective film including the conductive powder is preferably $1\times10^9$ Ω/sq. or more and $1\times10^{14}$ Ω/sq. or less. The volume resistivity of the surface protective film is preferably $1\times10^8$ Ωcm or more and $1\times10^{13}$ Ωcm or less.

The surface resistivity and volume resistivity are measured in conformity with JIS K 6911 in an environment of 22° C. and 55% RH using HIRESTA UPMCP-450 type UR Probe manufactured by DIA INSTRUMENTS Co., Ltd.

Urethane Resin

The composition of the self-healing urethane resin according to this exemplary embodiment will be described. The self-healing urethane resin according to this exemplary embodiment is produced by polymerization of a hydroxyl group-containing acrylic resin and an isocyanate.

The self-healing urethane resin according to this exemplary embodiment may be highly cross-linked. The phrase "highly cross-linked" means that the hydroxyl value of a prepolymer is 50 mgKOH/g or more and 400 mgKOH/g or less and 90% or more of hydroxyl groups contribute to a urethane bond.

Monomers for forming the hydroxyl group-containing acrylic resin are divided into (1) ethylenic monomers having a hydroxyl group, (2) ethylenic monomers having a carboxyl group, and (3) ethylenic monomers that have no hydroxyl groups but are copolymerized with the monomers (1) and (2). Examples of the monomers (1) include hydroxymethyl (meth)acrylate, hydroxyethyl (meth)acrylate, hydroxypropyl (meth)acrylate, hydroxybutyl (meth)acrylate, and N-methylol acrylamide. Examples of the monomers (2) include (meth) acrylic acid, crotonic acid, itaconic acid, fumaric acid, and maleic acid. Examples of the monomers (3) include alkyl (meth)acrylates such as methyl (meth)acrylate, ethyl (meth) acrylate, propyl (meth)acrylate, butyl (meth)acrylate, n-propyl (meth)acrylate, n-butyl (meth)acrylate, isobutyl (meth) acrylate, 2-ethylhexyl (meth)acrylate, n-octyl (meth) acrylate, and n-dodecyl (meth)acrylate.

To achieve the above-described cross-linking density, the hydroxyl value of the hydroxyl group-containing acrylic resin is preferably 50 mgKOH/g or more and 400 mgKOH/g or less or about 50 mgKOH/g or more and about 400 mgKOH/g or less.

The self-healing property of the surface protective film is controlled by adjusting the amount of side-chain hydroxyl group having less than 10 carbon atoms (short-side-chain hydroxyl group) in the hydroxyl group-containing acrylic resin, the amount of side-chain hydroxyl group having 10 or more carbon atoms (long-side-chain hydroxyl group), and the type and amount of cross-linking agent. In particular, a hydroxyl group-containing acrylic resin having no long-side-chain hydroxyl groups or a hydroxyl group-containing acrylic resin in which the ratio ([A]/([A]+[B])) of the molar quantity [A] of the short-side-chain hydroxyl group to the total of the molar quantity [A] and the molar quantity [B] of the long-side-chain hydroxyl group is 80% or more or about 80% or more may be used. The ratio ([A]/([A]+[B])) is preferably 90% or more or about 90% or more.

Herein, a side chain having less than 10 carbon atoms is defined as a "short side chain" and a side chain having 10 or more carbon atoms is defined as a "long side chain". The number of carbon atoms of the short side chain is preferably 6 or less.

When the hydroxyl group-containing acrylic resin has the long-side-chain hydroxyl group, a monomer obtained by adding ϵ-caprolactone to 3-5 mol hydroxymethyl (meth)acrylate may be used as the monomer for forming the hydroxyl group-containing acrylic resin. One or more of hydroxyl group-containing acrylic resins may be used.

The hydroxyl group-containing acrylic resin may have a bulky group. The "bulky group" is a substituent that causes steric hindrance. The presence of such a bulky group restricts the rotational motion or the like because portions constituting molecules intramolecularly and intermolecularly interfere with each other. Examples of the bulky group include isobornyl, dicyclopentadiene, isobornyloxyethyl, dicyclopentenyl, cyclohexyl, an isopropyl group, a t-butyl group, and a phenyl group.

A hydroxyl group-containing acrylic resin obtained by polymerizing the following monomer having a bulky group is preferably used because the presence of a bulky group increases the hardness, for example. Examples of the monomer having a bulky group include isobornyl (meth)acrylate, dicyclopentadiene (meth)acrylate, isobornyloxyethyl (meth) acrylate, dicyclopentenyl (meth)acrylate, and cyclohexyl (meth)acrylate.

The hydroxyl group-containing acrylic resin may contain a fluorine atom. Examples of the acrylic resin containing a fluorine atom include copolymers obtained by polymerizing monomers such as 2-(perfluorobutyl)ethyl acrylate, 2-(perfluorohexyl)ethyl acrylate, 2-(perfluorohexyl)ethyl methacrylate, and perfluorohexylethylene. The content of the fluorine atom is 5 mass % or more and 50 mass % or less relative to the total mass of the urethane resin. When the hydroxyl group-containing acrylic resin contains a fluorine atom, a surface protective film having high releasability is produced.

For the purpose of suppressing discharge degradation, controlling the restoration ratio within the above-described range, and suppressing electrostatic charge, the self-healing urethane resin according to this exemplary embodiment is desirably a urethane resin formed by polymerizing at least the following compositions (a), (b), and (c) or a urethane resin formed by polymerizing at least the following compositions (a') and (c).

(a) Hydroxyl group-containing acrylic resin which has a hydroxyl value of 50 mgKOH/g or more and 400 mgKOH/g or less or about 50 mgKOH/g or more and about 400 mgKOH/g or less and in which the ratio ([A]/([A]+[B])) of the molar quantity [A] of the short-side-chain hydroxyl group to the total of the molar quantity [A] and the molar quantity [B] of the long-side-chain hydroxyl group is 80% or more or about 80% or more (note that the long-side-chain hydroxyl group may be not included)

(b) At least one silicone selected from the compounds represented by general formula (1) below (c) Isocyanate (a') Acrylic resin which has a hydroxyl value of 50 mgKOH/g or more and 400 mgKOH/g or less or about 50 mgKOH/g or more and about 400 mgKOH/g or less and contains the compound represented by general formula (2) below as one of monomers in an amount of 1 mass % or more and 50 mass % or less and in which the ratio ([A]/([A]+[B])) of the molar quantity [A] of the short-side-chain hydroxyl group to the total of the molar quantity [A] and the molar quantity [B] of the long-side-chain hydroxyl group is 80% or more or about 80% or more (note that the long-side-chain hydroxyl group may be not included)

(1)

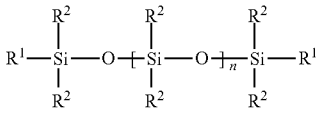

In the general formula (1), $R^1$ represents an amino group, a hydroxyl group, a methoxy group, or an ethoxy group; $R^2$ represents a methyl group, a phenyl group, or an ethyl group; n is not particularly limited, but is preferably 3 or more and 1000 or less.

(2)

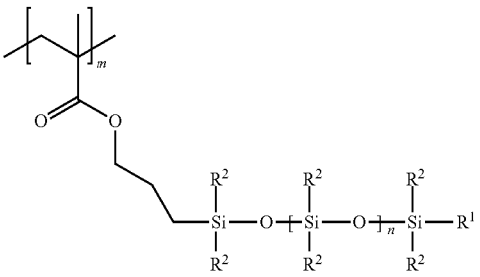

In the general formula (2), $R^1$ represents an amino group, a hydroxyl group, a methoxy group, or an ethoxy group; $R^2$ represents a methyl group, a phenyl group, or an ethyl group; n is not particularly limited, but is preferably 3 or more and 1000 or less; and m is not particularly limited, but is preferably 3 or more and 1000 or less.

The urethane resin formed by polymerizing at least the above compositions (a), (b), and (c) or the urethane resin formed by polymerizing at least the above compositions (a') and (c) are obtained through the polymerization of the above compositions (a), (b), and (c) or the above compositions (a') and (c), and the hydroxyl value of the hydroxyl group-containing acrylic resin (a) or the hydroxyl group-containing acrylic resin (a') is within the above-described range. Therefore, it is believed that the cross-linking density is high and thus the resistance to discharge degradation is high. It is also believed that such a urethane resin does not directly react to an impact (e.g., an impact caused by contact with a recording medium such as paper) in a use environment, but flexibly yields once to reduce the impact and then bends back with its high elastic force, resulting in recovery to the original state. That is, such a urethane resin is believed to have high resistance to discharge degradation, high scratch resistance (difficulty in formation of scratches), and high scratch healing speed (restoration of formed scratches). Furthermore, such a urethane resin is obtained through the polymerization of the silicone (b) or the hydroxyl group-containing acrylic resin (a') having a silicone chain as its side chain. Therefore, it is believed that a good sliding property, high scratch resistance in a use environment, and high heat resistance are achieved. This also provides a surface protective film having high releasability.

In the urethane resin according to this exemplary embodiment, the mass ratio of a monomer having a silicone chain (Si—O) to all monomers used when the urethane resin is polymerized is 1 mass % or more and 50 mass % or less. For example, when the urethane resin is formed by polymerizing the above compositions (a), (b), and (c), the mass ratio mentioned herein is the mass ratio of the silicone monomer (b) to all monomers. When the urethane resin is formed by polymerizing the above compositions (a') and (c), the mass ratio mentioned herein is the mass ratio of a monomer having a silicone chain (Si—O) among monomers used to synthesize the acrylic resin (a') relative to all monomers. When the urethane resin is formed by polymerizing the above compositions (a'), (b), and (c), the mass ratio mentioned herein is the mass ratio of the silicone monomer (b) and a monomer having a silicone chain (Si—O) among monomers used to synthesize the acrylic resin (a') relative to all monomers.

The restoration ratio is controlled by adjusting, for example, the amount of the silicone, the amount of the silicone chain in the acrylic resin, and the type and amount of cross-linking agent. In particular, when the urethane resin is formed by polymerizing the above compositions (a), (b), and (c) or the above compositions (a') and (c), the restoration ratio is controlled by adjusting, for example, the amount of the long-side-chain hydroxyl group and the amount of the short-side-chain hydroxyl group.

When the long-side-chain hydroxyl group is not included or the ratio ([A]/([A]+[B])) is 80% or more or about 80% or more, a urethane resin having high resistance to discharge degradation is produced. The ratio ([A]/([A]+[B])) is preferably 90% or more or about 90% or more.

When the hydroxyl value is equal to or more than the lower limit, a urethane resin having high cross-linking density is polymerized, resulting in a urethane resin having high resistance to discharge degradation. When the hydroxyl value is equal to or lower than the upper limit, a urethane resin having appropriate flexibility is produced. The hydroxyl value is preferably 70 mgKOH/g or more and 280 mgKOH/g or less or about 70 mgKOH/g or more and about 280 mgKOH/g or less.

The hydroxyl value represents the number of milligrams of potassium hydroxide required to acetylate a hydroxyl group in 1 g of a sample. In this exemplary embodiment, the hydroxyl value is measured by a method (potentiometric titration) provided in JIS K 0070-1992. When a sample is not dissolved, a solvent such as dioxane or THF is used.

The hydroxyl group-containing acrylic resin in this exemplary embodiment is synthesized by, for example, mixing the monomers described above, performing typical radical polymerization or ionic polymerization, and then purifying the obtained polymer.

In this exemplary embodiment, at least one of at least one silicone (b) selected from the compounds represented by the general formula (1) and at least one hydroxyl group-containing acrylic resin (a') selected from the compounds having a silicone chain as its side chain and represented by the general formula (2) is used as silicone.

As described above, in the general formulae (1) and (2), $R^1$ represents an amino group, a hydroxyl group, a methoxy group, or an ethoxy group. Among them, a hydroxyl group or a methoxy group is preferred in terms of reactivity or the like. $R^2$ represents a methyl group, a phenyl group, or an ethyl group. Among them, a methyl group or a phenyl group is preferred in terms of compatibility or the like.

The molecular weight of the silicone (b) represented by the general formula (1) and the molecular weight (weight-average molecular weight) of a silicone (silicone monomer) bonded, as a side chain, to the hydroxyl group-containing acrylic resin (a') represented by the general formula (2) are preferably 250 or more and 50000 or less and more preferably 500 or more and 20000 or less.

Specific examples of the silicone (b) represented by the general formula (1) and the silicone (silicone monomer) bonded, as a side chain, to the hydroxyl group-containing acrylic resin (a') represented by the general formula (2) include KF9701, KF8008, and KF6001 (manufactured by Shin-Etsu Chemical Co., Ltd.); and TSR160, TSR145, TSR165, and YF3804 (manufactured by Momentive Performance Materials Inc.).

The isocyanate functions as a cross-linking agent between the hydroxyl group-containing acrylic resin and the silicone, between the hydroxyl group-containing acrylic resins, and between the silicones. Non-limiting examples of the isocyanate include diisocyanates such as methylene diisocyanate, toluene diisocyanate, hexamethylene diisocyanate, and isophorone diisocyanate; polyfunctional isocyanates (e.g., polyisocyanate (Duranate) manufactured by Asahi Kasei Corp.) having a biuret structure, an isocyanurate structure, or an adduct structure, which are multimers of hexamethylene polyisocyanate. These isocyanates may be used in combination as a mixture of two or more. In particular, when high cross-linking density is required, a high-flexure grade isocyanate may be used in an amount of 10% to 100%. A blocked isocyanate may be used so that a reaction does not occur until a particular temperature.

The ratio ((i)/(ii)) of the content (i) of the isocyanate to the amount (ii) of the hydroxyl group in the hydroxyl group-containing acrylic resin is preferably 0.7 or more and 3 or less and more preferably 0.9 or more and 2 or less.

Method for Forming Surface Protective Film

A method for forming the surface protective film according to this exemplary embodiment (method for polymerizing a resin) will now be described. For example, a method for forming a protective film sample for evaluation is described. When the hydroxyl group-containing acrylic resin (a), the silicone (b), and the isocyanate (c) are polymerized, the hydroxyl group-containing acrylic resin (a), the silicone (b), and the isocyanate (c) are mixed with each other and the conductive powder is added thereto at the above-described volume ratio. After defoaming is performed under reduced pressure, the mixed solution is applied onto a polyimide film having a thickness of 90 μm by casting to form a resin layer sample for evaluation. The sample is cured by performing heating at 85° C. for 60 minutes and then at 160° C. for 30 minutes. In practice, the mixed solution is applied onto a surface to be protected and cured by performing heating in the same manner.

The method for forming a surface protective film according to this exemplary embodiment is not particularly limited to the method for polymerizing the compositions (a), (b), and (c). For example, when a blocked isocyanate is used, heating is performed to a temperature equal to or higher than the unblocking temperature and then curing is performed. Furthermore, ultrasonic waves may be used instead of the defoaming under reduced pressure or the mixed solution may be defoamed by being left to stand. The urethane resin according to this exemplary embodiment is also formed by polymerizing the hydroxyl group-containing acrylic resin (a') and the isocyanate (c).

The thickness of the surface protective film is not particularly limited, and is preferably 1 μm or more and 500 μm or less and more preferably 10 μm or more and 100 μm or less.

[Application]

As described above, the surface protective film according to this exemplary embodiment is used, without being limited, for products in which scratches are formed on the surface while at the same time electrostatic charge is generated due to contact with foreign matter. Examples of the products include a screen and body of portable devices such as cellular phones and portable gaming devices, a body and door knob of automobiles, the exterior of a piano, a transfer member in image forming apparatuses, and a hanger.

The application of the surface protective film according to this exemplary embodiment will now be described.

<Transfer Member>

A transfer member according to this exemplary embodiment at least includes a base and the surface protective film according to this exemplary embodiment, the surface protective film being formed on the base.

When a surface protective film including the self-healing urethane resin and the conductive powder at the above-described volume ratio relative to the urethane resin is formed on a base, a transfer member which has an excellent self-healing property and whose discharge degradation is suppressed is obtained.

Examples of a raw material used for the base of the transfer member according to this exemplary embodiment include polyimide resin, polyamide-imide resin, polyester resin, polyamide resin, and fluorocarbon resin. Among them, polyimide resin and polyamide-imide resin are preferably used.

In the case where the transfer member according to this exemplary embodiment is a transfer belt, the base may have seams or may be seamless as long as the base is a ring-shaped belt (endless belt). The base has a thickness of, for example, 0.02 mm or more and 0.2 mm or less. The belt-shaped transfer member includes a ring-shaped (endless) base and a surface protective film formed on the surface of the base. The surface protective film has a thickness of, for example, 1 μm or more and 100 μm or less.

In the case where the transfer member according to this exemplary embodiment is a transfer roller, the base may have a cylindrical shape. The base has a thickness of, for example, 3 mm or more and 10 mm or less. The roll-shaped transfer member includes a cylindrical base and a surface protective film formed on the surface of the base. The surface protective film has a thickness of, for example, 1 μm or more and 100 μm or less.

The contact angle of the surface protective film of the transfer member according to this exemplary embodiment is preferably 60 degrees or more and more preferably 80 degrees or more. When the contact angle is 80 degrees or more, high releasability is achieved.

The contact angle is controlled by adjusting, for example, the amount of fluorine atoms contained in the hydroxyl group-containing acrylic resin and the long chain polyol and the amount of silicone.

The dynamic contact angle (advancing contact angle) is measured in the following manner. A water droplet is dropped on a solid surface of a resin material by using a syringe. The water droplet is expanded by injecting water thereinto. A contact angle at an instant when the contact surface between the resin material and the water increases is measured as the dynamic (advancing) contact angle. The receding contact angle is measured in the following manner. After the measurement of the advancing contact angle, the water in the water droplet is sucked up. A contact angle just before the contact surface between the resin material and the water decreases is measured as the receding contact angle. The contact angle is measured at room temperature (25° C.) using Contact angle meter (Model: CAS manufactured by Kyowa Interface Science Co., Ltd.).

—Process Cartridge and Image Forming Apparatus—

An image forming apparatus according to this exemplary embodiment includes, for example, an electrostatic latent image carrier (hereinafter may be referred to as "photoconductor"), an electrostatic latent image forming device that forms a latent image (electrostatic latent image) on a surface of the electrostatic latent image carrier, a developing device that forms a toner image by developing, with toner, the electrostatic latent image formed on the surface of the electrostatic latent image carrier, an intermediate transfer body including the transfer member according to this exemplary embodiment, a first transfer device that transfers the toner image formed on the electrostatic latent image carrier onto the intermediate transfer body, and a second transfer device that transfers the toner image on the intermediate transfer body onto a recording medium.

When the transfer member includes, on a base, the surface protective film containing the self-healing urethane resin and the conductive powder at the above-described volume ratio relative to the urethane resin, an image forming apparatus including a transfer member that achieves an excellent self-healing property of the surface and suppresses the discharge degradation is obtained.

In the image forming apparatus, for example, a unit including the transfer member may have a cartridge structure (process cartridge) that is detachably attachable to the main body of the image forming apparatus. The process cartridge is not particularly limited as long as the process cartridge includes the transfer member according to this exemplary embodiment. An example of the process cartridge is a process cartridge that includes the transfer member according to this exemplary embodiment and a developing device which forms a toner image by developing, with toner, the electrostatic latent image formed on the electrostatic latent image carrier and that is detachably attachable to the image forming apparatus.

When the transfer member includes, on a base, the surface protective film containing the self-healing urethane resin and the conductive powder at the above-described volume ratio relative to the urethane resin, a process cartridge including a transfer member that achieves an excellent self-healing property of the surface and suppresses the discharge degradation is obtained.

The image forming apparatus according to this exemplary embodiment includes the transfer member. FIGURE is a schematic diagram for describing a principal part of a tandem-type image forming apparatus including at least one of an intermediate transfer belt and a transfer roller as the transfer member.

Specifically, an image forming apparatus 1 includes a photoconductor 26 (electrostatic latent image carrier), a charging roller 34 that charges a surface of the photoconductor 26, a laser generating device 24 (electrostatic latent image forming device) that forms an electrostatic latent image by exposing the surface of the photoconductor 26, a developing device 38 that forms a toner image by developing, with a developer, the latent image formed on the surface of the photoconductor 26, an intermediate transfer belt 40 (intermediate transfer body) onto which the toner image formed by the developing device 38 is transferred from the photoconductor 26, a first transfer roller 28 (first transfer device) that transfers the toner image onto the intermediate transfer belt 40, a photoconductor cleaning member 36 that removes toner, dust, and the like attached to the photoconductor 26, a second transfer roller 18 (second transfer device) that transfers the toner image on the intermediate transfer belt 40 onto a recording medium, and a fixing device 12 that fixes the toner image on the recording medium. The first transfer roller 28 may be disposed directly above the photoconductor 26 as illustrated in FIGURE, but is not necessarily disposed directly above the photoconductor 26.

The structure of the image forming apparatus 1 illustrated in FIGURE will be further described in detail. In the image forming apparatus 1, the charging roller 34, the developing device 38, the first transfer roller 28 disposed so as to face the photoconductor 26 with the intermediate transfer belt 40 therebetween, and the photoconductor cleaning member 36 are disposed around the photoconductor 26 in a counterclockwise direction. A set of these members form a developing unit that corresponds to one color. A toner cartridge 10 that supplies the developer to the developing device 38 is disposed for each developing unit. The laser generating device 24 is disposed for the photoconductors 26 of the developing units. The laser generating device 24 irradiates a surface portion of each photoconductor 26 with laser light in accordance with image information, the surface portion being present on the downstream side of the charging roller 34 (in the direction in which the photoconductor 26 rotates) and on the upstream side of the developing device 38.

Four developing units corresponding to four colors (e.g., cyan, magenta, yellow, and black) are horizontally arranged in a line in the image forming apparatus 1. The intermediate transfer belt 40 is disposed so as to be passed through transfer regions between the photoconductors 26 and the first transfer rollers 28 of the four developing units. The intermediate transfer belt 40 is supported by a support roller 14, a support roller 16, and a driving roller 30 that are sequentially arranged counterclockwise inside the intermediate transfer belt 40. Thus, a belt supporting device 42 is provided. The four first transfer rollers 28 are positioned on the downstream side of the support roller 14 (in the direction in which the intermediate transfer belt 40 rotates) and on the upstream side of the support roller 16. A transfer cleaning member 32 that cleans the outer peripheral surface of the intermediate transfer belt 40 is disposed so as to face the driving roller 30 with the intermediate transfer belt 40 therebetween and so as to be in contact with the driving roller 30.

The second transfer roller 18 that transfers a toner image formed on the outer peripheral surface of the intermediate transfer belt 40 onto a surface of recording paper transported from a sheet supplying unit 22 through a sheet transport path 20 is disposed so as to face the support roller 14 with the intermediate transfer belt 40 therebetween and so as to be in contact with the support roller 14.

The sheet supplying unit 22 that contains recording media is disposed in a bottom portion of the image forming apparatus 1. A recording medium is supplied from the sheet supplying unit 22 so as to be passed through the sheet transport path 20 and the nip between the support roller 14 and the second transfer roller 18 that constitute a second transfer unit. The recording medium that has been passed through the nip is further transported by a transporting device (not shown) so as to be passed through the nip of the fixing device 12. Finally, the recording medium is discharged from the image forming apparatus 1.

A method for forming an image by using the image forming apparatus 1 illustrated in FIGURE will now be described. The formation of a toner image is performed in each developing unit. The surface of the photoconductor 26 being rotated counterclockwise is charged by the charging roller 34. Then, a latent image (electrostatic latent image) is formed on the charged surface of the photoconductor 26 by the laser generating device 24 (exposure device). Subsequently, the latent image is developed with a developer supplied from the developing device 38 to form a toner image. The toner image that has been transported to the nip between the first transfer roller 28 and the photoconductor 26 is transferred onto the outer peripheral surface of the intermediate transfer belt 40 being rotated in the direction indicated by arrow C. The photoconductor 26 after the transfer of a toner image is subjected to cleaning of toner, dust, and the like attached to the surface of the photoconductor 26 by the photoconductor cleaning member 36. Thus, the photoconductor 26 is prepared for the next formation of a toner image.

The toner images developed by the developing units corresponding to colors are sequentially stacked on the outer peripheral surface of the intermediate transfer belt 40 so as to correspond to image information. The thus-superimposed toner images are transported to a second transfer unit and transferred by the second transfer roller 18 onto a surface of recording paper that has been transported from the sheet supplying unit 22 through the sheet transport path 20. The recording paper onto which the toner images have been transferred is then pressed and heated when the recording paper is passed through the nip of the fixing device 12. As a result, the toner images are fixed to form an image on the surface of the recording medium. Then, the recording medium is discharged from the image forming apparatus 1.

<Portable Device>

The surface protective film according to this exemplary embodiment is used as a protective film for a screen and body of portable devices.

The screen and body of portable devices such as cellular phones and portable gaming devices may become scratched as a result of contact with and rubbing against the tips (nails) of fingers or the tip of a control stick. Furthermore, static electricity builds up on the screen and body as a result of rubbing against, for example, a cloth in a bag or a clothes pocket, and thus dust easily adheres to the screen and body. In contrast, when the surface protective film according to this exemplary embodiment is formed, the formation of scratches is suppressed. Even if scratches are formed, the scratches heal and thus the formation of scratches (permanent scratches) permanently left on the surface is efficiently suppressed. Furthermore, since high conductivity is provided, the electrostatic charge is suppressed and thus the adhesion of dust is suppressed.

<Body and Door Knob of Automobile>

The surface protective film according to this exemplary embodiment is used as a protective film for a body and door knob of automobiles.

The body and door knob of automobiles are exposed to an outdoor environment and thus may become scratched due to various factors such as contact with sand, leaves, branches, and the like that are carried by wind and contact with insects and the like. Furthermore, static electricity builds up due to exposure to an outdoor environment, and thus dust easily adheres to the body and door knob. In particular, when a person touches a door knob being charged with static electricity, the static electricity is discharged. In contrast, when the surface protective film according to this exemplary embodiment is formed, the formation of scratches is suppressed. Even if scratches are formed, the scratches heal and thus the formation of scratches (permanent scratches) permanently left on the surface is efficiently suppressed. Furthermore, since high conductivity is provided, the electrostatic charge is suppressed and thus the adhesion of dust is suppressed.

<Exterior of Piano>

The surface protective film according to this exemplary embodiment is used as a protective film for the exterior of a piano.

The exterior of a piano may become scratched as a result of contact with musical instruments being played by other players or contact with various objects caused when the piano itself is moved. Furthermore, the exterior of a piano is often wiped with a dry cloth when cleaning. Static electricity builds up as a result of rubbing with the dry cloth, and thus dust easily adheres to the exterior. In contrast, when the surface protective film according to this exemplary embodiment is formed, the formation of scratches is suppressed. Even if scratches are formed, the scratches heal and thus the formation of scratches (permanent scratches) permanently left on the surface is efficiently suppressed. Furthermore, since high conductivity is provided, the electrostatic charge is suppressed and thus the adhesion of dust is suppressed.

<Hanger>

The surface protective film according to this exemplary embodiment is used as a protective film for a hanger.

The surface of a hanger may become scratched as a result of contact with a belt and buttons and clothes may become caught on the scratches. Furthermore, static electricity builds up on plastic hangers when clothes made of a chemical fiber are hung on and taken off. In contrast, when the surface protective film according to this exemplary embodiment is formed, the formation of scratches is suppressed. Even if scratches are formed, the scratches heal and thus the formation of scratches (permanent scratches) permanently left on the surface is efficiently suppressed. Furthermore, since high conductivity is provided, the electrostatic charge is suppressed and thus the adhesion of dust is suppressed.

EXAMPLES

The present invention will now be more specifically described in detail based on Examples and Comparative Examples, but is not limited to Examples below. Hereafter, "part" means "part by mass" unless otherwise specified.

Example 1

Synthesis of Hydroxyl Group-Containing Acrylic Resin Prepolymer

A hydroxyl group-containing acrylic resin prepolymer A1 is synthesized by solution polymerization.

Specifically, hydroxyethyl methacrylate (HEMA), which is a monomer serving as a short-side-chain hydroxyl group, a polycaprolactam-containing monomer (FM3 manufactured by Daicel Corporation), and a fluorine-containing acrylic monomer (FAMAC6 manufactured by UNIMATEC CO., LTD.) are mixed with each other at a molar ratio of 3:2:1. A silicon-containing monomer (Silaplane 711 manufactured by JNC CORPORATION) is added thereto in an amount of 20 mass % relative to the total mass of the above mixture, and a polymerization initiator (benzoyl peroxide, BPO) and butyl acetate are further added thereto in amounts of 5 mass % and 10 mass % relative to the total mass of the monomers, respectively, to prepare a monomer solution. The monomer solution is inserted into a dropping funnel and dropped into 100 mass % (relative to the monomers) of butyl acetate that is heated to 110° C. while flowing nitrogen, under stirring over three hours to polymerize the monomers. Furthermore, a solution composed of 30 mass % (relative to the monomers) of butyl acetate and 0.5 mass % (relative to the monomers) of BPO is dropped into the reaction solution over one hour to complete the reaction. The reaction solution is always kept at 110° C. under stirring during the reaction. As a result, an acrylic resin prepolymer A1 is synthesized.

[Formation of Surface Protective Film Sample]

The prepolymer is mixed with an isocyanate and other additives and defoamed. Then, a surface protective film sample A1 is formed by a heat curing method.

Specifically, a solution A below and a solution B below are mixed with each other at a ratio below. A conductive powder dispersion solution C is then gradually added to the mixture solution under stirring and defoaming is performed under reduced pressure for 10 minutes. The resultant solution is applied onto a polyimide film having a thickness of 90 μm by casting, cured at 85° C. for one hour, and further cured at 160° C. for one hour to obtain a surface protective film sample A1 having a thickness of 40 μm.

Solution A: 21.6 parts (the above-described acrylic resin prepolymer A1, 46.3 mass %, hydroxyl value: 132)

Solution B: 4.3 parts (isocyanate, Duranate TKA100 manufactured by Asahi Kasei Chemicals Corp., compound name: hexamethylene diisocyanate having a polyisocyanurate structure)

Solution C: a solution obtained by dispersing 1.6 parts of conductive powder (carbon black manufactured by Mitsubishi Chemical Corporation, trade name: MA100) in 16 parts of butyl acetate

[Measurement of Average Particle Size of Conductive Powder]

The average particle size of conductive powder contained in the surface protective film sample is measured using a transmission electron microscope (H-9000 manufactured by Hitachi High-Technologies Corporation). Table 1 shows the results. The average particle size is an average of particle sizes of 100 particles measured.

(Evaluation)

[Evaluation of Discharge Degradation in Terms of Resistance Value]

The surface resistivity of the surface protective film sample is measured using Ultra-high Resistance Meter R8340A manufactured by ADVANTEST CORPORATION and UR Probe manufactured by Mitsubishi Chemical Analytech Co., Ltd. The resistance to discharge degradation is evaluated in accordance with the criteria below. Table 1 shows the results.

Excellent: No decrease in resistance value is caused in both paper passing area and non-paper passing area.

Good: A decrease in resistance value is within a decrease of one order of magnitude in both paper passing area and non-paper passing area.

Fair: A decrease in resistance value is within a decrease of one order of magnitude in either paper passing area or non-paper passing area.

Poor: A decrease in resistance value is a decrease of two or more orders of magnitude in both paper passing area and non-paper passing area.

[Evaluation of Self-Healing Property]

The self-healing property of the surface protective film sample is evaluated by measuring the restoration ratio at 30° C. using the following method. Table 1 shows the results. FISCHERSCOPE HM2000 (manufactured by Fischer Instruments K.K.) is used as a measurement device. A sample urethane resin layer formed by performing coating on a polyimide film is fixed on a slide glass with an adhesive and the slide glass is set on a hot stage of the measurement device. A load is applied to the sample urethane resin layer up to 0.5 mN at 30° C. over 15 seconds and held at 0.5 mN for 5 seconds. The maximum displacement at this timing is defined as (h1). Subsequently, the load is decreased to 0.005 mN over 15 seconds and held at 0.005 mN for 1 minute. The displacement at this timing is defined as (h2). The restoration ratio is calculated from the formula [(h1−h2)/h1]. Table 1 shows the results.

Excellent: The restoration ratio is 100% and scratches are not left.

Good: The restoration ratio is 80% or more and scratches disappear within one hour.

Fair: Scratches disappear within one week.

Poor: Scratches do not disappear even after one week.

Example 2

An acrylic resin prepolymer and a surface protective film sample are produced and evaluated in the same manner as in Example 1, except that the amount of conductive powder (carbon black) added is changed to 20 mass %. Table 1 shows the results.

Example 3

An acrylic resin prepolymer and a surface protective film sample are produced and evaluated in the same manner as in Example 1, except that the amount of conductive powder (carbon black) added is changed to 30 mass %. Table 1 shows the results.

Example 4

An acrylic resin prepolymer and a surface protective film sample are produced and evaluated in the same manner as in Example 1, except that the amount of conductive powder (carbon black) added is changed to 8 mass %. Table 1 shows the results.

Example 5

An acrylic resin prepolymer and a surface protective film sample are produced and evaluated in the same manner as in Example 1, except that a conductive powder (carbon black) having an average particle size of 16 nm is used and the amount of conductive powder (carbon black) added is changed to 20 mass %. Table 1 shows the results.

Example 6

An, acrylic resin prepolymer and a surface protective film sample are produced and evaluated in the same manner as in Example 1, except that a conductive powder (carbon black) having an average particle size of 30 nm is used and the amount of conductive powder (carbon black) added is changed to 20 mass %. Table 1 shows the results.

Example 7

An acrylic resin prepolymer and a surface protective film sample are produced and evaluated in the same manner as in Example 1, except that a conductive powder (carbon black) having an average particle size of 47 nm is used and the amount of conductive powder (carbon black) added is changed to 20 mass %. Table 1 shows the results.

Example 8

An acrylic resin prepolymer and a surface protective film sample are produced and evaluated in the same manner as in Example 1, except that the ratio of HEMA:FM3:FAMAC6 is set to be 2.5:2.5:1 to adjust the hydroxyl value of the acrylic resin prepolymer to be 120 and the amount of conductive powder (carbon black) added is changed to 20 mass %. Table 1 shows the results.

Example 9

An acrylic resin containing a fluorine atom and silicone are not used. Specifically, an acrylic resin prepolymer and a surface protective film sample are produced and evaluated in the same manner as in Example 1, except that the fluorine-containing acrylic monomer (FAMAC6 manufactured by UNIMATEC CO., LTD.) is changed to n-butyl methacrylate (nBMA), the silicon-containing monomer (Silaplane 711) is not used, the molar ratio of HEMA:FM3:nBMA is changed to 1:2:3, and the amount of conductive powder (carbon black) added is changed to 20 mass %. Table 1 shows the results.

Example 10

An acrylic resin prepolymer and a surface protective film sample are produced and evaluated in the same manner as in Example 1, except that the fluorine-containing acrylic monomer (FAMAC6 manufactured by UNIMATEC CO., LTD.) is changed to n-butyl methacrylate (nBMA) so as not to use the acrylic resin containing a fluorine atom, the molar ratio of HEMA:nBMA is changed to 2:1, the amount of silicone is changed to 11 mass %, the amount of conductive powder (carbon black) added is changed to 20 mass %, and Duranate TKA100 serving as the B solution (isocyanate) is changed to Duranate E402 (Asahi Kasei Chemicals Corp.). Table 1 shows the results.

Example 11

An acrylic resin prepolymer and a surface protective film sample are produced and evaluated in the same manner as in Example 1, except that the silicon-containing monomer (Silaplane 711) is not used, the molar ratio of HEMA:FM3:FAMAC6 is changed to 1:2:3, the amount of fluorine is changed to 11 mass %, and the amount of conductive powder (carbon black) added is changed to 20 mass %. Table 1 shows the results.

Example 12

An acrylic resin prepolymer and a surface protective film sample are produced and evaluated in the same manner as in Example 1, except that titanium oxide is used instead of carbon black serving as the conductive powder and the amount of conductive powder (titanium oxide) added is changed to 30 mass %. Table 1 shows the results.

Comparative Example 1

An acrylic resin prepolymer and a surface protective film sample are produced and evaluated in the same manner as in Example 1, except that the amount of conductive powder (carbon black) added is changed to 3.4 vol % (5 mass %). Table 1 shows the results.

Comparative Example 2

An acrylic resin prepolymer and a surface protective film sample are produced and evaluated in the same manner as in Example 1, except that the amount of conductive powder (carbon black) added is changed to 26 vol % (35 mass %). Table 1 shows the results.

Comparative Example 3

An acrylic resin prepolymer and a surface protective film sample are produced and evaluated in the same manner as in Example 1, except that the hydroxyl value of the acrylic resin prepolymer is changed to 2 and the amount of conductive powder (titanium oxide) added is changed to 20 mass %. Table 1 shows the results.

TABLE 1

| | Urethane resin | | | Conductive powder | | | | Evaluation | | |
|---|---|---|---|---|---|---|---|---|---|---|
| | Amount of fluorine | Amount of Silicone | Hydroxyl value | Type | Particle size | Amount added | | Discharge degradation in terms of resistance value | Restoration ratio | Self-healing property for scratch |
| Unit | wt % | wt % | mgKOH/g | — | nm | vol % | wt % | — | % | — |
| Ex. 1 | 9 | 10 | 132 | CB | 25 | 7 | 10 | Good | 100 | Excellent |
| Ex. 2 | 9 | 10 | 132 | CB | 25 | 14.3 | 20 | Good | 95 | Good |
| Ex. 3 | 9 | 10 | 132 | CB | 25 | 22 | 30 | Good | 79 | Fair |
| Ex. 4 | 9 | 10 | 132 | CB | 25 | 5.5 | 8 | Good | 100 | Excellent |
| Ex. 5 | 9 | 10 | 132 | CB | 16 | 14.3 | 20 | Good | 95 | Good |
| Ex. 6 | 9 | 10 | 132 | CB | 30 | 14.3 | 20 | Good | 89 | Good |
| Ex. 7 | 9 | 10 | 132 | CB | 47 | 14.3 | 20 | Fair | 93 | Good |
| Ex. 8 | 9 | 10 | 120 | CB | 25 | 14.3 | 20 | Fair | 100 | Excellent |
| Ex. 9 | 0 | 0 | 112 | CB | 25 | 14.3 | 20 | Fair | 100 | Excellent |
| Ex. 10 | 0 | 11 | 232 | CB | 25 | 14.3 | 20 | Excellent | 85 | Good |
| Ex. 11 | 11 | 0 | 71 | CB | 25 | 14.3 | 20 | Fair | 100 | Excellent |
| Ex. 12 | 9 | 10 | 132 | $TiO_2$ | 25 | 10.7 | 30 | Good | 76 | Fair |
| C.E. 1 | 9 | 10 | 132 | CB | 25 | 3.4 | 5 | Poor | 100 | Excellent |
| C.E. 2 | 9 | 10 | 132 | CB | 25 | 26 | 35 | Fair | 65 | Poor |
| C.E. 3 | 9 | 10 | 2 | CB | 25 | 14.3 | 20 | Good | 35 | Poor |

Ex.: Example
C.E.: Comparative Example

In Examples 3 and 12, the restoration ratio at 30° C. is less than 80% as shown in Table 1. However, when the surface protective film sample is heated to 40° C., the restoration ratio increases to 80% or more and thus an evaluation of "Good" is given for the self-healing property for scratches.

[Measurement of Surface Resistivity]

The surface resistivity of the surface protective film sample is measured using Ultra-high Resistance Meter R8340A manufactured by ADVANTEST CORPORATION and UR Probe manufactured by Mitsubishi Chemical Analytech Co., Ltd.

[Evaluation of Adhesive Property of Dust]

The adhesive property of dust is evaluated by the following method.

The surface of the surface protective film sample is lightly rubbed with BEMCOT twenty times, and then polymethyl methacrylate (PMMA) particles having a particle size of 300 nm are lightly rubbed against the surface with a brush. After the surface protective film sample is turned upside down to remove excess powder (particles), the adhesive property of dust is evaluated in accordance with the amount of PMMA particles adhering to the surface.

Good: The powder adheres to the surface in a scattered manner.

Fair: The surface of the surface protective film sample is seen, but a large amount of powder adheres to the surface.

Poor: The surface of the surface protective film sample appears white as a result of being covered with the powder.

TABLE 2

| | Evaluation | |
|---|---|---|
| (Unit) | Surface resistivity Ω/sq. | Adhesive property of dust — |
| Example 1 | $3 \times 10^{13}$ | Good |
| Example 2 | $5 \times 10^{10}$ | Good |
| Example 3 | $4 \times 10^{6}$ | Good |
| Example 4 | $1 \times 10^{13}$ | Fair |
| Example 5 | $6 \times 10^{9}$ | Good |
| Example 6 | $1 \times 10^{9}$ | Good |
| Example 7 | $5 \times 10^{9}$ | Good |
| Example 8 | $8 \times 10^{10}$ | Good |
| Example 9 | $4 \times 10^{10}$ | Good |
| Example 10 | $7 \times 10^{10}$ | Good |
| Example 11 | $7 \times 10^{10}$ | Good |
| Example 12 | $5 \times 10^{9}$ | Good |
| Comparative Example 1 | $2 \times 10^{15}$ | Poor |
| Comparative Example 2 | $2 \times 10^{2}$ | Good |
| Comparative Example 3 | $6 \times 10^{10}$ | Good |

As described above, in the surface protective film samples of Examples that include the self-healing urethane resin and the conductive powder whose content is 5 vol % or more and 25 vol % or less or about 5 vol % or more and about 25 vol % or less relative to the volume of the urethane resin, an excellent self-healing property of the surface is achieved, the electrostatic charge is suppressed, and the discharge degradation is suppressed compared with the surface protective film samples of Comparative Examples.

[Example of Cellular Phone]

A PET film on which the surface protective film of Example 2 is formed is pasted in an upper portion of the screen of a cellular phone (TOSHIBA, biblio) and the cellular phone is used in a usual manner for one month. After one month, the states of formation of scratches and adhesion of dust are confirmed through visual inspection in a portion covered with the surface protective film and a portion covered with no surface protective film. Small scratches are confirmed in the portion covered with no surface protective film, but no scratches are confirmed in the portion covered with the surface protective film. Furthermore, the trace of fingerprints is not easily seen in the portion covered with the surface protective film.

[Example of Door Knob of Automobile]

An imide film on which the surface protective film of Example 10 is formed is pasted on a door knob and in a depressed portion of the door knob of TOYOTA SIENTA and the car is used in a usual manner for one month. Electrostatic charge that builds up when a person touches the door knob to open and close a door is not felt during the use for one month. Scratches to be formed due to contact with nails are also not seen on the surface protective film.

[Example of Hanger]

A polystyrene hanger is coated with the surface protective film of Example 2. An action of hanging on and taking off a 100% polyester blouse is repeatedly performed twenty times, and then the adhesive property of dust is evaluated using PMMA particles (powder) as described above. Almost no powder adheres to the surface protective film. The formation of scratches is also not confirmed through visual inspection.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A surface protective film comprising:

a self-healing urethane resin urethane resin has a restoration ratio of about 80% or more and about 100% or less, the restoration ratio being measured by the following method: a load is applied to the surface protective film up to 0.5 mN at a particular measurement temperature over 15 seconds and held at 0.5 mN for 5 seconds, which provides a maximum displacement (h1); then, the load is decreased to 0.005 mN over 15 seconds and held at 0.005 mN for 1 minute, which provides a displacement (h2); and the restoration ratio is calculated from formula $[\{(h1-h2)/h1\}\times 100(\%)]$; and a conductive powder, wherein the conductive powder is composed of carbon black and the conductive powder is about 5 vol % or more and about 25 vol % or less relative to the volume of the urethane resin, and wherein the conductive powder has an average particle size of about 10 nm or more and about 30 nm or less.

2. The surface protective film according to claim 1, wherein the content of the conductive powder is about 8 mass % or more and about 30 mass % or less relative to the mass of the urethane resin.

3. The surface protective film according to claim 1, wherein the conductive powder has an average particle size of about 15 nm or more and about 25 nm or less.

4. The surface protective film according to claim 1, wherein the urethane resin is formed by polymerization of a hydroxyl group-containing acrylic resin and an isocyanate.

5. The surface protective film according to claim 4, wherein the hydroxyl group-containing acrylic resin has a hydroxyl value of about 50 mgKOH/g or more and about 400 mgKOH/g or less.

6. The surface protective film according to claim 4, wherein the hydroxyl group-containing acrylic resin has a ratio [A]/([A]+[B]) of about 80% or more, where [A] is a molar quantity of a side-chain hydroxyl group having less than 10 carbon atoms and [B] is a molar quantity of a side-chain hydroxyl group having 10 or more carbon atoms.

7. The surface protective film according to claim 6, wherein the hydroxyl group-containing acrylic resin has a ratio [A]/([A]+[B]) of about 90% or more.

8. The surface protective film according to claim 1, wherein the urethane resin includes at least one of a structural unit containing silicone and a structural unit containing a fluorine atom.

9. A transfer member comprising:

a base; and the surface protective film according to claim 1, the surface protective film being formed on the base.

10. An image forming apparatus comprising:

an electrostatic latent image carrier;

an electrostatic latent image forming device that forms an electrostatic latent image on a surface of the electrostatic latent image carrier;

a developing device that forms a toner image by developing, with toner, the electrostatic latent image formed on the surface of the electrostatic latent image carrier;

an intermediate transfer body including the transfer member according to claim 9;

a first transfer device that transfers the toner image formed on the electrostatic latent image carrier onto the intermediate transfer body; and a second transfer device that transfers the toner image on the intermediate transfer body onto a recording medium.

11. A method for forming an image, comprising:

charging a surface of an electrostatic latent image carrier by a charging device;

forming an electrostatic latent image on the charged surface of the electrostatic latent image carrier by an electrostatic latent image forming device;

developing the electrostatic latent image with a developer to form a toner image;

transferring the toner image onto an intermediate transfer body including the transfer member according to claim 9;

transferring the toner image on the intermediate transfer body onto a recording medium; and fixing the toner image on the recording medium.

* * * * *